United States Patent [19]

Kerner et al.

[11] Patent Number: 4,637,743

[45] Date of Patent: Jan. 20, 1987

[54] MATRIX PRINTER AND INKER FOR INDEFINITE LENGTH ARTICLES

[76] Inventors: Aron Kerner, 1531 N. Fuller Ave. Apt. 27, Los Angeles, Calif. 90046; Andrei Grombchevsky, 24 Lancewood Way, Irvine, Calif. 92715

[21] Appl. No.: 798,139

[22] Filed: Nov. 14, 1985

Related U.S. Application Data

[63] Continuation of Ser. No. 653,083, Sep. 21, 1984, abandoned.

[51] Int. Cl.[4] ..... B41F 17/10; B41J 3/20; B41J 31/14; B41J 35/04

[52] U.S. Cl. ..... 400/124; 400/198; 400/248; 101/35

[58] Field of Search ..... 400/120, 121, 124, 125, 400/126, 88, 198, 202.2, 202.3, 202.4, 248, 466; 101/35, 93.04, 93.05

[56] References Cited

U.S. PATENT DOCUMENTS

| | | | |
|---|---|---|---|
| 926,764 | 7/1909 | Phillips | 400/202.2 X |
| 2,694,362 | 11/1954 | Paige | 101/93.04 |
| 3,202,257 | 8/1965 | Rihm | 400/466 |
| 3,467,232 | 8/1969 | Paige | 101/93.04 X |
| 3,625,334 | 12/1971 | Ahn | 400/202.2 X |
| 3,933,091 | 1/1976 | Von Saspe | 101/40 |
| 4,029,006 | 6/1977 | Mercer | 400/126 X |
| 4,037,705 | 7/1977 | Martin et al. | 101/93.05 X |
| 4,327,636 | 5/1982 | Carey | 101/93.05 X |
| 4,359,748 | 11/1982 | Pasini et al. | 400/120 X |

FOREIGN PATENT DOCUMENTS

| | | | |
|---|---|---|---|
| 0065585 | 5/1980 | Japan | 400/202 |
| 0155982 | 9/1983 | Japan | 400/198 |
| 185275 | 10/1983 | Japan | 400/198 |

*Primary Examiner*—Clifford D. Crowder

*Attorney, Agent, or Firm*—Bruce A. Jagger; Natan Epstein

[57] ABSTRACT

A stationary dot matrix printer for printing both continuously variable and repetitive information on a moving substrate utilizing a readily replaceable ink applicator for applying ink to a blank foil adjacent to the printing station.

11 Claims, 4 Drawing Figures

MATRIX PRINTER AND INKER FOR INDEFINITE LENGTH ARTICLES

Figure 1:
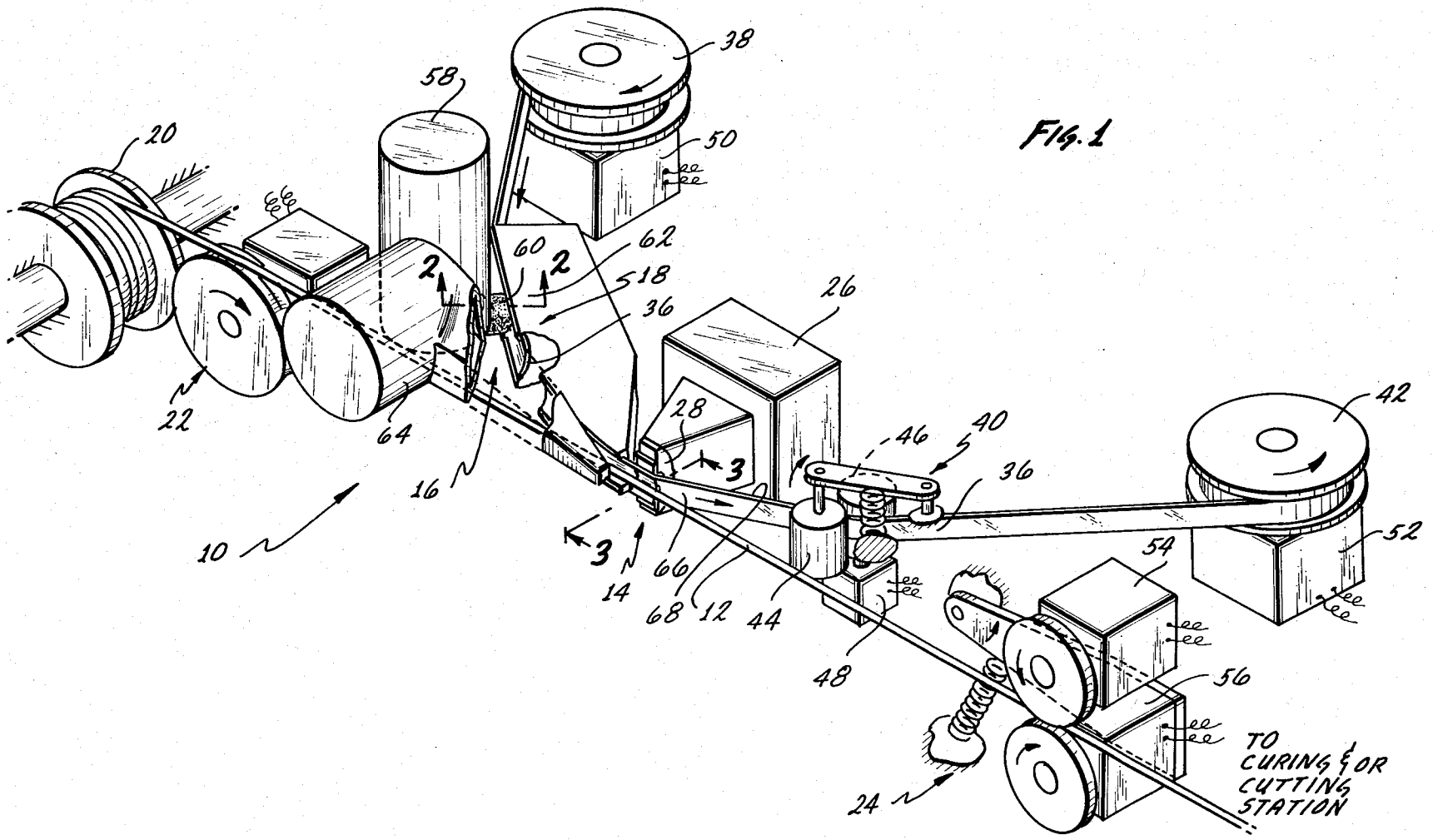

This is a continuation of application Ser. No. 653,083, filed Sept. 21, 1984, now abandoned.

Previously, considerable difficulty had been experienced in printing and, in particular, in printing variable information on wire and tubing of different kinds.

Previous expedients have included laser etching machines which physically burn the outer face of the substrate which is being marked with a resultant loss in structural integrity, as well as indistinct markings on dark colored substrates. Various ink jet marking machines have been proposed, but are limited in the range of marking fluids which can be accommodated because of a tendency of the tiny ink jets to clog. Also, changing from one ink system to another requires that the ink dispensing system be throughly cleansed throughout. Because of the limited range of marking fluids, it has been difficult or impossible to permanently mark certain substrate materials. Further expedients have included fixed information stamps where the information to be recorded on the face of substrate is fixed and can only be changed by stopping the marking operation and replacing the marking head. Various cutting and embossing procedures have been proposed, all of which suffer from the fact that they impair the structural integrity of the substrate.

These and other difficulties of the prior art have been overcome according to the present invention wherein a printer is provided for printing markings which are variable at will without interrupting the printing operation. Further, according to the present invention a wide variety of surfaces of different materials, characteristics and shapes may be printed or marked. In general, the printing system, according to the present invention, comprises subject matter which is in the nature of a special-purpose word processsor which will accommodate many different arcuate and plane shapes and print receiving surfaces. The subject matter of the present invention is particularly applicable to the application of variable markings on materials in the nature of insulated wire and tubing, and is particularly adapted for rapidly changing from one print receiving substrate to another where the substrates differ in at least one of shape or print receiving characteristics.

In general, the printing system, according to the present invention, comprises a printing station at which is located a stationary dot matrix impact printing head. The print wires in the printing head are conveniently arrayed so that the impact ends of the wires define a configuration which conforms generally to the configuration of the surface or face of the print receiving substrate to which the dot matrix print is to be applied. The print receiving substrate is moved continuously past the printing station at a controlled rate which may be fixed or variable as desired. The printing is accomplished at the printing station while the face of the print receiving substrate which receives the dot matrix printing is moving. A web or foil is provided between the impact printing ends of the print wires and the print receiving face of the substrate. The foil or web moves from a web supply member past the printing station to a spent web takeup member. Between the web supply member and the printing station a readily removable ink supply member is positioned so as to apply a marking fluid to one surface of the foil or web just prior to its entering the printing station. At the printing station the marking media which has been applied at the inking station is on the side of the foil or web which faces the surface which is to receive the dot matrix printing. The impact of the impacting printing ends of the print wires on the opposite side of the foil trnasfers the marking media to the print receiving face of the moving substrate.

The ink supply member is mounted for ready removal and replacement in the printing system so that the marking media can be changed with only a momentary interruption of operations. The only loss in material which occurs during a changeover from one marking media to another is the foil and the marking media adhered thereto which exists between the ink supply station and the printing station at the time the operation is interrupted for the marking media changeover. Since this generally represents at most only a few inches of foil, the cost is generally nominal. The time required to exchange ink supply members is generally on the order of a few minutes, so the lost production time at the occasion of a marking media changeover is also generally nominal. The ability to change over permits the use of a wide variety of marking media, including those which have short useful lives, for example, by reason of being compounded with curable materials which have short pot lives. High viscosity marking media which require heating to achieve the desired degree of fluidity may be used if desired. Marking media which may be loaded with particulate matter with such particle sizes that they will not pass through small orifices may be utilized with various large pore sized or orifice sized applicators. The marking media may be applied to the surface of the foil by means of any desired technique, including spraying, rolling, swabbing, or the like. The marking media applicator is generally demountable with the ink supply member. Thus, virtually any marking media may be accommodated rapidly, efficiently and without difficulty according to the present invention.

Optionally, various treatments such as heat, sound, light, radiation, or the like, may be applied to one or more of the foil, the marking media, or the print receiving substrate of improving the characteristics of the dot matrix printing on the print receiving face of the substrate. The foil or web may be conveniently heated so as to improve the printability of the system. Heat may also be applied to the print receiving face of the substrate so long as the degree of heat is not sufficient to impair the structural integrity of the substrate. Where the marking media includes a light or other radiation curable polymer, the curing may be effected by applying a suitable radiation source to the printing system. The virtually limitless flexibility of the printing system, according to the present invention, permits the efficient marking of even very difficult to mark materials such as polyflurocarbons and silicone polymers.

The use of a dot matrix printing head permits virtually unlimited instantaneous control over the information to be printed on the print receiving face of the substrate. This control is achieved through the application of conventional word processing program techniques. The printed information which can be continuously varied at will includes alphanumeric information, figures, designs, bar codes, and the like. The printed information may be varied as desired without interrupting the operation of the printing system.

The entire operation is conveniently controlled by conventional control means so that the various web and substrate supply and takeup stations are coordinated in their operations with the printing station. Preferably, the printing system is controlled so that the web or foil only moves with the continuously moving substrate while printing is actually in progress. The foil preferably hesitates in its advance past the printing station when printing is not actually occurring. This substantially reduces the amount of foil which is consumed in the operation of the printing system according to the present invention.

The present printing system with its ability to print a continuously variable message on a constantly running substrate, and its ability to rapidly change marking media to provide any desired characteristics in the printed information, is ideally suited to efficiently processing small quantities of specialized wire or tubing. Readily interchangeable printing heads which provide different configurations of the shapes defined by the impact printing ends of the print wires may be provided to accommodated various shaped of print receiving faces. This feature is particularly advantageous where large variations in the diameter of tubing or wire occurs from the one production run to the next. The printing head is preferably detachably mounted so that it is quickly and conveniently changeable in like manner as the ink supply member. The dot matrix print head is constructed utilizing conventional dot matrix impact printing head technology.

Figure 2:
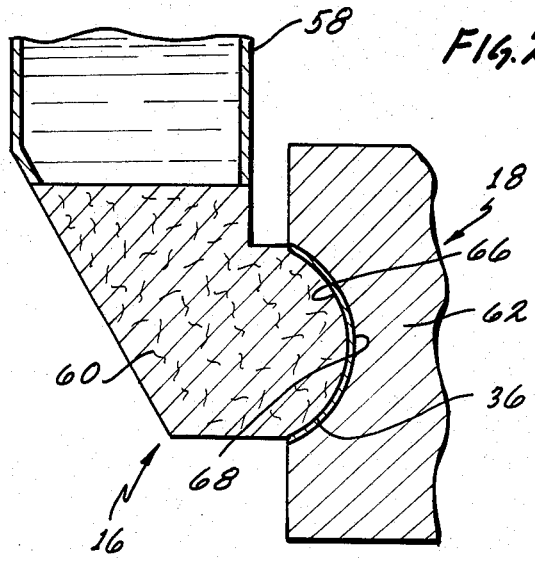
Figure 4:
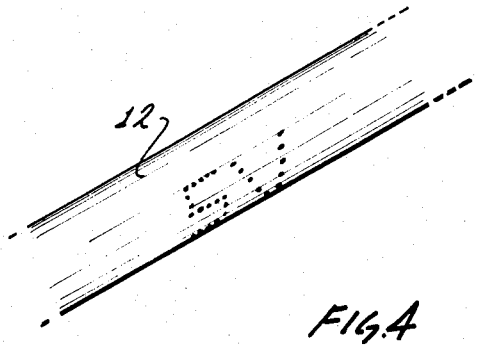
Figure 3:
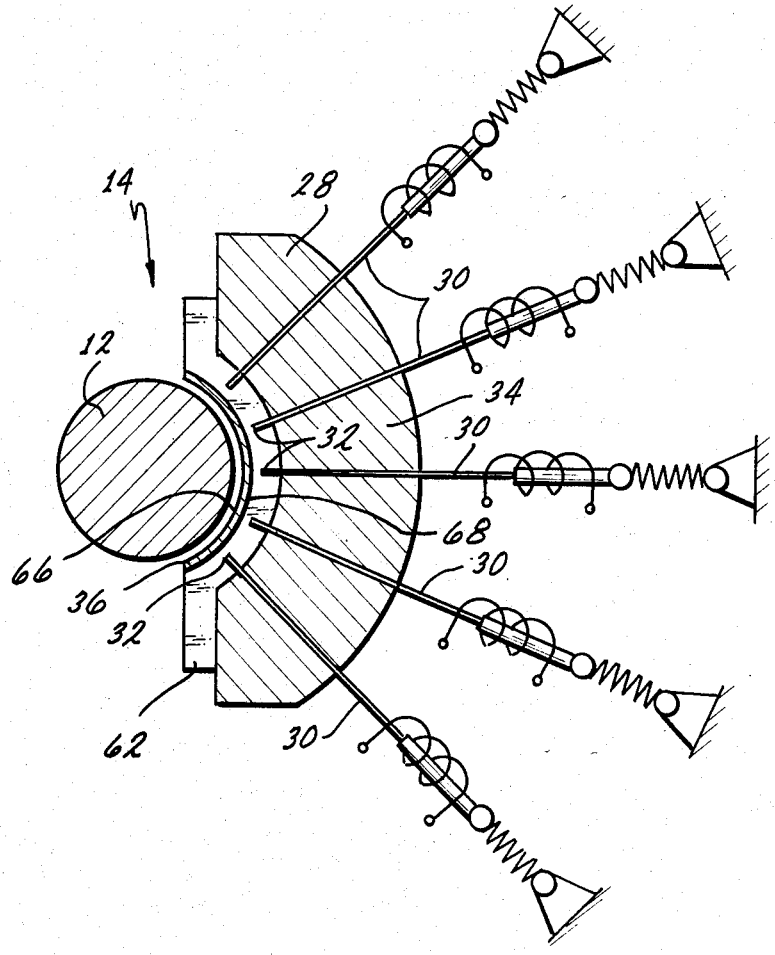

Referring particulary to the drawings for the purposes of illustration only, and not limitation, there is illustrated at:

FIG. 1, a perspective view of a printing system adapted for printing on wire and tubing having a cylindrical print receiving face;

FIG. 2, a cross-sectional view of an inking station and heat treating station taken along line 2—2 in FIG. 1;

FIG. 3, a cross-sectional view of a printing station taken along line 3—3 in FIG. 1; and FIG. 4, a perspective view of a wire having dot matrix printing imprinted on the face thereof.

Referring particulary to the drawings, there is illustrated generally at 10, a printing system which is particularly adapted to applying dot matrix printing on a continuously moving elongated cylindrical substrate.12. The printing system 10 includes a printing station indicated generally at 14, an ink supply station indicated generally at 16, and a foil heat treating station indicated generally at 18. Substrate 12 is delivered to the printing system 10 from substrate supply reel 20 through encoder 22 past printing station 14 to takeup drive 24. The transport system for the substrate 12 which comprises the supply reel 20, encoder 22, and takeup drive 24 comprises various conventional electrical motor drives which are coordinated by control system 26. Control system 26 is electrically connected, through connections which are not illustrated, to the various drives of printing system 10 through conventional electrical circuitry. Pneumatic, mechanical or hydraulic operating systems and controls may be employed if desired, however, electrical controls are generally preferred. Control system 26 also includes conventional word processing facilities for controlling the operation of dot matrix impact printing head 28. Dot matrix impact printing head 28 includes magnetically driven, spring biased print wires 30, which are constructed according to conventional dot matrix printing head techniques. Each of the print wires 30 is provided with an impact end 32. Each of the print wires 30 is mounted for reciprocal motion in block 34. Printing head 28 is detachably mounted at printing station 14, so as to permit easy removal and remounting for maintenance and configuration change purposes.

Foil 36 moves from web supply reel 38 past ink supply station 16, foil heat treating station 18, and printing station 14 to web drive station 40, and finally to web takeup reel 42. Web drive station 40 includes pinch rollers 44 and 46, respectively. Pinch roller 44 is spring biased into contact with pinch roller 46 so as to grip foil 36 between the two pinch rollers. Pinch roller 46 is driven intermittently by stepper motor 48. The action of the pinch rollers combined with the stepper motor is such that foil 36 advances past printing station 14 only when the stepper motor 48 is actuated. Stepper motor 48 is controlled by control system 26 so that foil 36 is moving codirectionally with substrate 12 at the same rate as substrate 12 only when impact ends 32 of print wires 30 are activated. Web supply reel 38 is driven by web drive motor 50. Web takeup reel 42 is driven by web takeup motor 52. Web drive motor 50 is a torque motor which tends to drive the reel to which it is mounted in the direction indicated by the arrow on web supply reel 38. The action of torque motor 50 is overcome by the stronger force of stepper motor 48 when stepper motor 48 is actuated by control 26. Web takeup motor 52 is likewise a torque motor which drives web takeup reel 42 in the direction indicated by the arrow on web takeup reel 42. Similarly, the substrate transport system includes a substrate takeup drive 24 which is comprised of a pair of motor pulley combinations 54 and 56. Motor pulley combination 54 is spring biased into contac with substrate 12 so as to grip the substrate between the pulleys of the motor pulley combinations 54 and 56, respectively. The motor pulley combinations 54 and 56 act to pull substrate 12 past printing station 14 at a predetermined rate. The movement of substrate 12 under the urging of elements 54 and 56 actuates encoder 22 which transmits the information of the travel of substrate 12 to control system 26 through conventional electrical circuitry which is not shown.

Supply station 16 includes a readily detachable marking media container 58, and a marking media applicator 60. In the embodiment chosen for illustration, the marking media applicator 60 is in the form of a wick. Foil guide 62 performs a dual function. Foil guide 62 serves to configure the foil 36 to the form desired for usage at printing station 14. Foil guide 62 configures foil 36 into a semicircular form. In the embodiment illustrated, foil guide 62 also serves to heat foil 36 so as to enhance the desired characteristics of the dot matrix printing on substrate 12. Marking media applicator 60 is combined with and is removable with marking media container 58. A complete change in the marking media system may be accomplished merely by removing marking media container 58 and replacing it with an equivalent container which is set up with the desired marking media and applicator. In the embodiment illustrated, a hot air blower 64 is provided at a position which permits hot air to be blown on substrate 12 prior to its reaching printing station 14, as well as while it is at printing station 14. This hot air treatment may be utilized when desired to facilitate the printability of the substrate 12. As foil 36 advances past ink supply station 16, applicator 60 applies marking media to a first surface 66 of foil 36. At printing station 14 the inked first surface 66 is positioned relative to the print receiving face of substrate 12 so that the impact of impact ends 32 on the second surface 68 of foil 36 causes the marking media to be transferred from foil 36 to the print receiving face of substrate 12. The result is indicated particularly in FIG. 4 where dot matrix impact generated printing is illustrated on the print receiving face of substrate 12.

As illustrated particularly in FIG. 3 the print needles are preferably mounted in block 34 so that the impact ends 32 are arrayed in a configuration which at least generally approximates the contour of the print receiving face of substrate 12. Conforming the configuration defined by impact ends 32 to the general configuration of the print receiving face contributes significantly to the readability of the resultant print, particulary where the diameter of substrate 12 is small. In the embodiment illustrated particularly in FIG. 3, the impact ends 32 all travel approximately the same distance from their at rest positions to the point of impact with the print receiving face of substrate 12. For rapidly moving substrates, this contributes significantly to the readability of the print on the face. Conforming the shape of ribbon 36 to the same general configuration as the face of substrate 12 also contributes to the improved characteristics of the print.

The nature of the foil may be varied as desired to suit the particular requirements of the printing operation which is to be accomplished. The first surface of foil 36 may be treated in any desired manner to enhance printability. In general, foil first surface 66 is uncoated, however, coatings of various kinds may be provided if desired. First surface 66 may, for example, be coated with a catalytic material which acts with a polymer in the marking media to quickly polymerize and set the printing on the face of substrate 12.

The teachings of the present invention are not limited to substrates with generally cylindrical configurations. Other arcuate or plain configurations or combinations thereof are readily printed according to the present invention by utilizing appropriately configured printing heads.

As will be readily understood by those skilled in the art, what has been described are preferred embodiments in which modifications and changes may be made without departing from the spirit and scope of the accompanying claims.

What is claimed is:

1. A printer for printing both variable and repetitive information on a moving surface as such surface passes by a printing station, said printer comprising:

stationary dot matrix impact printing means for imprinting markings on a face of a moving substrate at a printing station;

substrate transport means for transporting said substrate continuously past said printing station in a first direction at a controlled rate;

web transport means for transporting an uninked foil element in said first direction past said printing station once between said face and said printing means from a web supply member to a web takeup member, said printing station being between said supply and takeup members;

detachable inking means including an ink supply and ink applicator means unitary with said ink supply for applying a marking media to a first previously uninked surface of said foil element as said foil element passes in said first direction between said supply member and said printing station, said first surface being disposed in position to contact said face responsive to the action of said printing means whereby said marking media is transferred from said first surface to said face at said printing station said inking means including said ink applicator means being readily detachable as a unit without removal or exchange of said foil element; and control means for coordinating the operation of said respective printing, substrate transport and web transport and for permitting continuous variation in said markings without interrupting said operation.

2. A printer of claim 1 including treatment means for altering the characteristics of at least one of said foil element, said marking media or said face to enhance the desired characteristics of said marking.

3. A printer of claim 2 wherein said treatment means includes means for heating said foil element.

4. A printer of claim 3 wherein said treatment means includes means for heating said face.

5. A printer of claim 1 wherein said stationary dot matrix impact printing means includes a plurality of print wires, each of which terminates in an impact printing end, said printing ends being arranged in a generally arcuate configuration adapted to conform generally to an arcuately shaped face.

6. A printer of claim 5 wherein said face is generally cylindrical and said printing ends being arranged in a generally semicircular configuration.

7. A printer of claim 5 wherein each of said printing ends is spaced about equidistant from said arcuately shaped face.

8. A printer of claim 1 wherein said web transport means includes stepping means for moving said foil element intermittently at said controlled rate only as said markings are being imprinted on said face.

9. A printer for printing both variable and repetitive information on a moving surface as such surface passes by a printing station, said printer comprising:

stationary dot matrix impact printing means including a plurality of print wires, each of which terminates in an impact printing end, said printing ends being arranged in a generally arcuate configuration adapted to conform generally to an arcuately shaped face for imprinting markings on a face of a moving substrate at a printing station;

substrate transport means for transporting said substrate continuously past said printing station in a first direction at a controlled rate;

web transport means for transporting an uninked foil element in said first direction past said printing station once between said face and said printing means from a web supply member to a web takeup member, said printing station being between said supply and takeup members;

web shaping means between said web supply member and said printing station for conforming said foil element generally to said arcuately shaped face; and detachable inking means inking a marking media applicator for applying a marking media to a first previously uninked surface of said foil elements said foil element passes in said first direction between said supply member and said printing station, said applicator cooperating with said web shaping means, said first surface being disposed in position to contact said face responsive to the action of said printing means whereby said marking media is transferred from said first surface to said face at said printing station, said inking means being readily detachable without removal or exchange of said foil element.

10. The printer of claim 9 wherein said marking media applicator is a wick element.

11. The printer of claim 9 wherein said web shaping means includes heater means for heating said foil for improved ink transfer characteristics.

* * * * *